US007387066B2

(12) United States Patent
Geise

(10) Patent No.: US 7,387,066 B2
(45) Date of Patent: Jun. 17, 2008

(54) CYLINDRICALLY-SHAPED CAN COLLECTION BIN FOR USE WITH ALUMINUM CAN COMPACTING MECHANISM

(76) Inventor: Gregory D. Geise, W127 N6541 Blue Spruce Ct., Menomoree Falls, WI (US) 53051

( * ) Notice: Subject to any disclaimer, the term of this patent is extended or adjusted under 35 U.S.C. 154(b) by 0 days.

(21) Appl. No.: 11/420,643

(22) Filed: May 26, 2006

(65) Prior Publication Data

US 2007/0272094 A1 Nov. 29, 2007

(51) Int. Cl.
*B30B 1/04* (2006.01)
*B30B 9/32* (2006.01)
*B65D 25/10* (2006.01)

(52) U.S. Cl. ..... 100/227; 100/283; 100/293; 100/902; 220/735; 220/751

(58) Field of Classification Search ..... 100/218, 100/227, 280, 283, 293, 902, 258 A; 220/298, 220/509, 669, 672, 675, 735, 751, 908; 215/379, 215/382, 398; D15/123; D9/527, 528, 531
See application file for complete search history.

(56) References Cited

U.S. PATENT DOCUMENTS 2,831,593 A * 4/1958 Sterges ..... 215/398
5,048,413 A * 9/1991 Deiters ..... 100/226
5,179,893 A * 1/1993 Richardson ..... 100/98 R
5,699,929 A * 12/1997 Ouno ..... 220/323
5,778,773 A * 7/1998 Clark ..... 100/218
6,076,455 A 6/2000 Geise
7,185,783 B1 * 3/2007 Miller ..... 220/675
2006/0021525 A1 2/2006 Geise

* cited by examiner

*Primary Examiner*—Jimmy T Nguyen
(74) *Attorney, Agent, or Firm*—Joseph S. Heino; Patrick M. Bergin

(57) ABSTRACT

An improved can compacting mechanism includes a can collection bin comprising a body having an integrally-formed and cylindrically-shaped sidewall. Downwardly from the cylindrical sidewall is a floor. The sidewall and floor are integrally formed into a single structure. Upwardly from the sidewall is a body neck and opening. The body neck is, in cross-section, a generally rectangular-shaped structure and the body opening is a generally rectangular-shaped aperture through which compacted cans are intended to pass as they drop by gravity from the can compacting mechanism of prior invention. The sidewall is a carrier for indicia applied to the sidewall or to a label or wrap that encircles the sidewall.

5 Claims, 6 Drawing Sheets

CYLINDRICALLY-SHAPED CAN COLLECTION BIN FOR USE WITH ALUMINUM CAN COMPACTING MECHANISM

FIELD OF THE INVENTION

This invention relates generally to mechanisms for compacting objects and to accessory items for such mechanisms. More particularly, it relates to a cylindrically-shaped can collection bin for use with an aluminum can compacting mechanism, which mechanism is manually actuated by a user and which uses gravity to discharge the compacted can from the mechanism and to collect the discharged can neatly within the bin. It also particularly relates to an improvement to a compacting mechanism of prior specific construction and to a novelty collection bin that can also be used, among other things, for advertising by beverage manufacturers who sell beverages in recyclable aluminum cans.

BACKGROUND OF THE INVENTION

In the experience of this inventor, the ability to recycle objects has become a necessity for the preservation of resources for future generations. Recycling of virtually anything that can be recycled has become a way of life in our energy-conscious society. No less important in this regard is the aluminum beverage can. According to statistics available to this inventor, more than 123,000 aluminum beverage cans are recycled every minute. In 1972, 53 million pounds of aluminum beverage cans were recycled. Today, we exceed that amount weekly. Perhaps most impressive is the fact that such recycling saves about 95% of the energy required to make aluminum from ore which also results in 95% less air pollution and 97% water pollution. Furthermore, of all aluminum that is recycled, over 60% is used by consumers. Accordingly, a movement has taken place to manufacture, distribute and sell aluminum beverage can crushing and compacting mechanisms that can be readily purchased and used by the consuming public. One such mechanism is disclosed in this inventor's U.S. Pat. No. 6,076,455.

The inventor's prior aluminum can compacting mechanism, as disclosed and claimed in U.S. Pat. No. 6,076,455, is a relatively compact, wall-mountable, easy to use, and commercially available device. That device utilizes a can retaining means into which the user or consumer manually places the aluminum beverage can that is to be compacted. A lever is actuated and the aluminum can is compacted between two compacting plates. In mechanisms of prior art, the activation lever is then reversed and the compacted can is manually removed from the device. Because this last step can be an unpleasant one due to the presence of beverage residue in such cans, and because it is a completely unnecessary step in his eyes, this inventor sought to eliminate it by constructing a more efficient device where the compacted can is automatically dropped from the device. That device is disclosed and claimed in U.S. Pat. No. 6,076,455. Another result intended to be accomplished by the device disclosed in U.S. Pat. No. 6,076,455, is that the handle be stopped in its downward rotation so as to prevent pinch points within the device, a particularly important feature where the device is used by small children.

Even with the advancement in efficiency and safety of his device, this inventor has also recognized the need for a convenient way to collect compacted cans as they are discharged from the aluminum can compacting mechanism as previously described. In particular, there is a need to provide a collection means that is conveniently and attractively located immediately beneath the subject can compacting mechanism. In the view of this inventor, the collection means should be functionally adapted to be removably attachable to the can compacting device of prior disclosure. This would ensure the inadvertent detachment of the collection means from the can compacting mechanism except where detachment was desired or required by the user. The collection means should be functionally adapted so as not to interfere with the operation of the prior can compacting mechanism, and particularly with regard to the full motion of the handle through its use cycle. The collection means should also be attractive in the accumulation, but not display, of unsightly compacted cans as they are collected. In this way, a can compacting mechanism that might otherwise be relegated to use in the garage, the basement, or some other location where it is generally out-of-sight, can now be located in a kitchen, a utility room, or other area of a home or dwelling where it is more likely to be used. The collection means should also be self-contained and cleanable to collect and allow the removal of any residue that may otherwise escape from the compacted cans. In this way, the collection means can be dishwasher cleaned as such is desired or required.

One such compacted can collection bin is disclosed and claimed in this inventor's co-pending U.S. application Ser. No. 10/959,728. While the bin of that application is novel and fully functional, its shape is designed to maximize the volume of its internal area so as to maximize the number of compacted cans that it can collect. This inventor has, however, also recognized that there is a need to develop a bin that is configured to serve as somewhat of a novelty item as well. That is, the bin of the present invention can be configured to represent a larger version of the very cans that it is intended to and collect after the cans have been compacted by the compacting mechanism of prior invention. The cylindrical collection bin of the present invention can be constructed to be as fully functional as the bin disclosed and claimed in this inventor's co-pending application, but can also be used, among other things, as a unique advertising means for beverage makers who sell beverages for consumption in aluminum cans. The cylindrical collection bin of the present invention has dual functionality as a device that catches compacted cans and as a device that helps to promote beverages that are sold to consumers in aluminum cans.

Accordingly, it is an object of the present invention to provide a new, useful and cylindrically-shaped compacted can collection bin that can be easily used by a consumer with an aluminum can compacting mechanism of prior invention, which bin has a minimal number of parts and requires only a minimal number of steps to use. It is another object of the present invention to provide such a novelty can collection bin that is conveniently locatable immediately beneath the aluminum can compacting mechanism of prior invention. It is yet another object of the present invention to provide such a cylindrically-shaped can collection bin that is functionally adapted to be removably attachable to the can compacting device of prior invention. It is still another object of the present invention to provide such a cylindrically-shaped can collection bin that includes means for preventing the inadvertent detachment of the bin from the can compacting mechanism except where detachment was desired or required by the user. It is a further object of the present invention to provide such a can collection bin that does not interfere with the operation of the prior can compacting mechanism, and particularly with regard to the full motion of the handle through its compression cycle. It is still another object of the present invention to provide such a can collection bin that is attractive in the accumulation, but not display, of unsightly compacted cans as they are collected so that the bin is more likely to be used in a kitchen or utility room setting rather than hidden away in a garage or basement. It is another object of the present invention to provide such a collection bin that can be fabricated in a one-piece, unitary construction and be self-contained and cleanable to collect and allow the removal of any residue that may escape from the compacted cans. It is yet another object of the present invention to provide such a can collection bin that can be fabricated in the form and shape of an over-sized, large aluminum can, the can containing a media for replicating the can labeling of a beverage manufacturer or other suitable images as well as private branding applications. In this regard, it is an object of this invention to make the bin an attractive and compact unit, as compared to bins of the prior art which are generally nothing more than large garbage cans placed underneath the compacting mechanism.

SUMMARY OF THE INVENTION

The cylindrically-shaped can collection bin of the present invention has obtained these objects. It provides for a main collection bin body that is integrally formed of a cylindrically-shaped sidewall that assumes the shape of a large aluminum beverage can. The collection bin body is symmetrical and unitary in construction. Downwardly from the cylindrical sidewall is a floor. In the preferred embodiment, the wall and floor are integrally formed into a single structure. Upwardly from the floor, the sidewall is tapered inwardly towards a body neck and opening. The body neck is, in cross section, a generally rectangular-shaped structure and the body opening is a generally rectangular-shaped aperture located at the uppermost portion of the body neck and through which compacted cans are intended to pass as they drop by gravity from between the compression plates of the can compacting mechanism of prior invention. Additionally, the bin includes a handle at the body neck for conveniently grasping the bin by hand for removing it from the compacting mechanism of prior invention and allowing the user to empty its contents without requiring any direct contact with the compacted cans. The taper of the neck of the bin body allows the can compacting mechanism of prior invention to operate through its full compression cycle without impediment and allows the compacted cans to freely pass through the neck. The uppermost portion of the bin neck also includes securement means comprised of opposing flanges that allow the bin to be easily and removably secured to the can compacting mechanism of prior invention. The securement means also includes a positive locking mechanism to prevent inadvertent detachment of the bin and provide the user with tactile or visual confirmation that the bin is secure in its proper position. The sidewall of the bin can be directly printed on as a means for advertising beverages that are sold in cans as well as other suitable images, including private branding applications. Alternatively, a separate media, such as a paper label, soft vinyl label or shrink-wrap plastic sleeve, can be secured about the sidewall of the bin for the same purpose.

The foregoing and other features of the novelty cylindrically-shaped can collection bin of the present invention will be apparent from the detailed description that follows.

DETAILED DESCRIPTION

Figure 1:
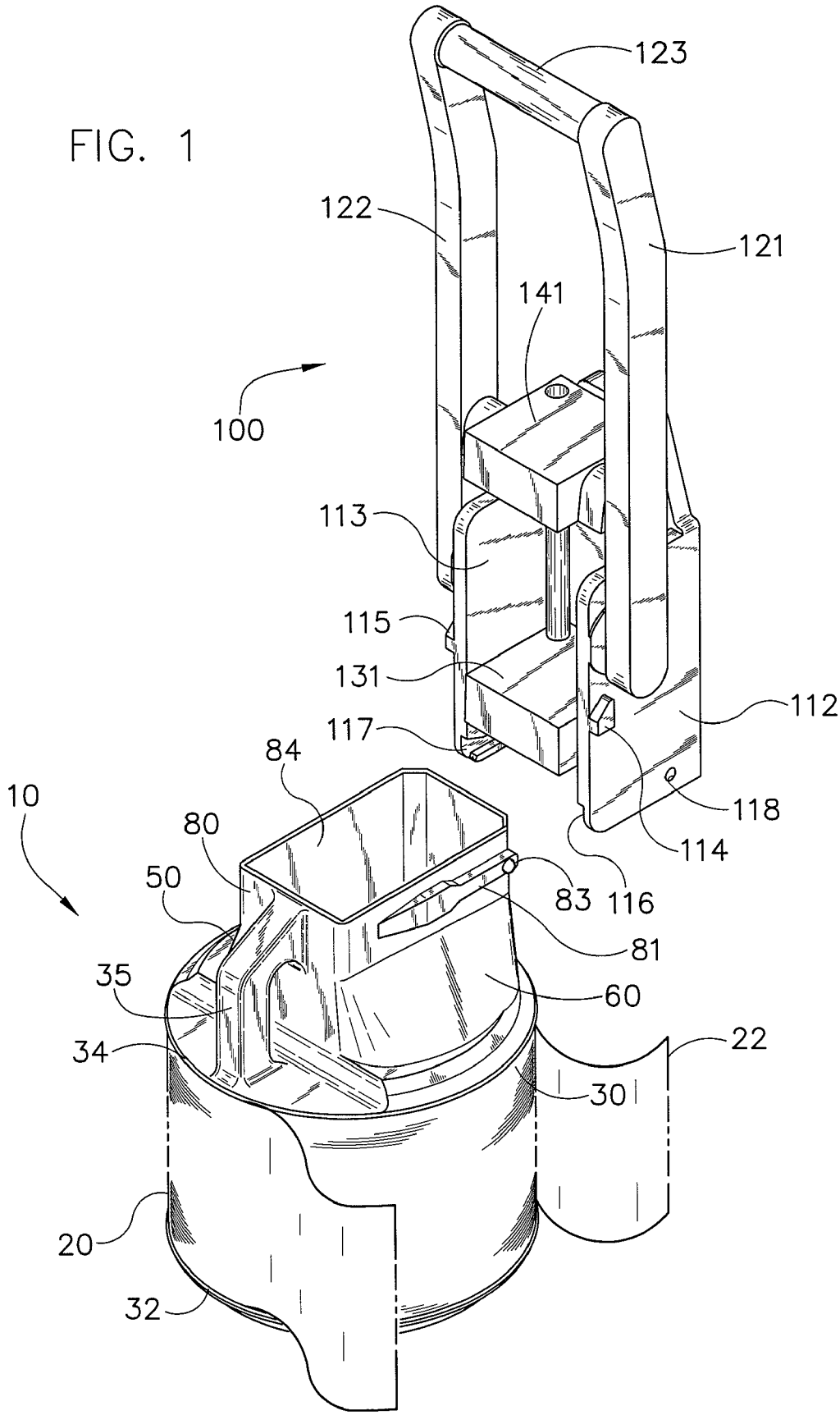
FIG. 1 is a front, top and right side perspective view of a cylindrically-shaped can collection bin constructed in accordance with the present invention and showing the bin detached from a can compacting mechanism of prior invention.
Figure 2:
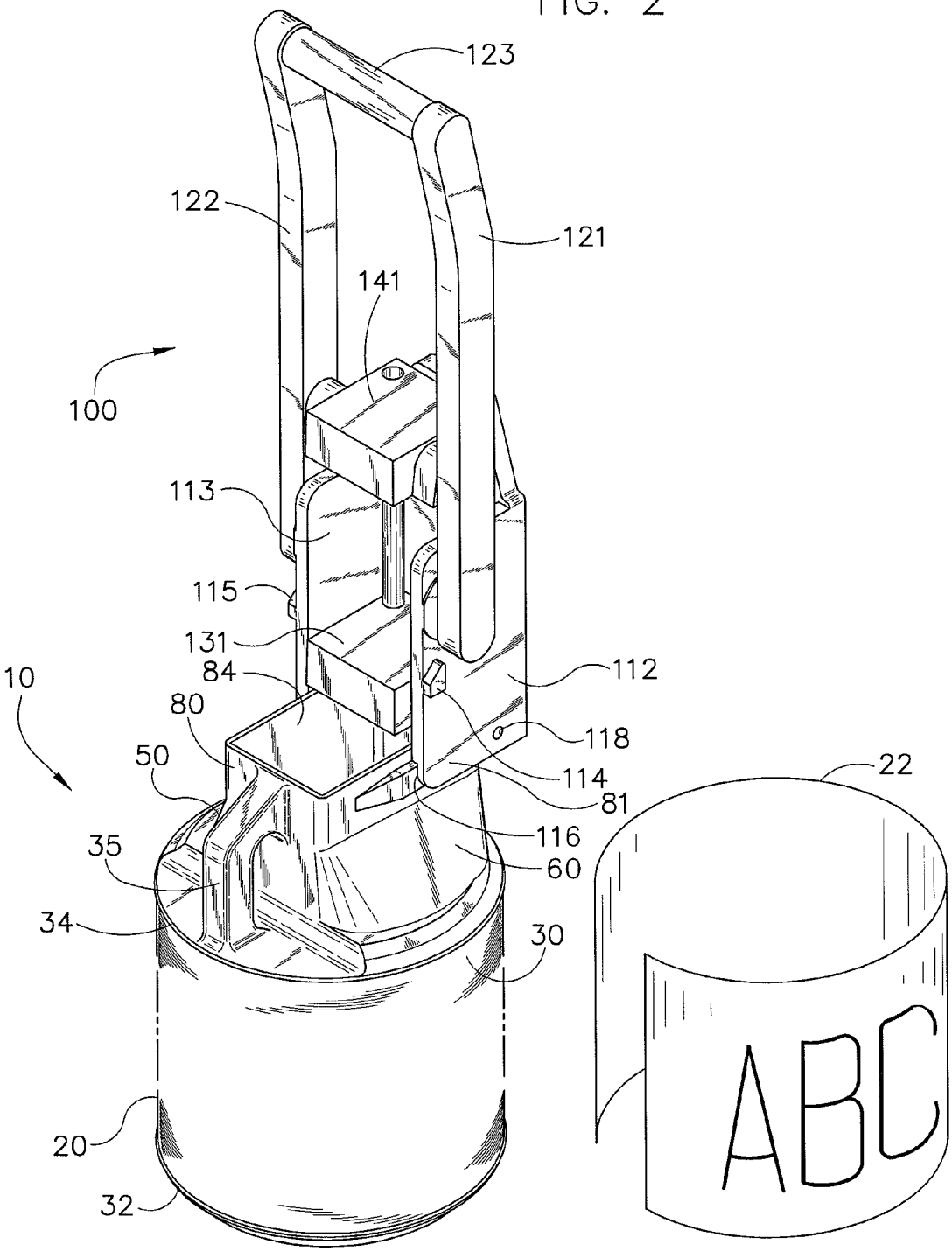
FIG. 2 is a front, top and right side perspective view of the cylindrically-shaped can collection bin constructed in accordance with the present invention as it would be used when attached to the can compacting mechanism of prior invention.
Figure 3:
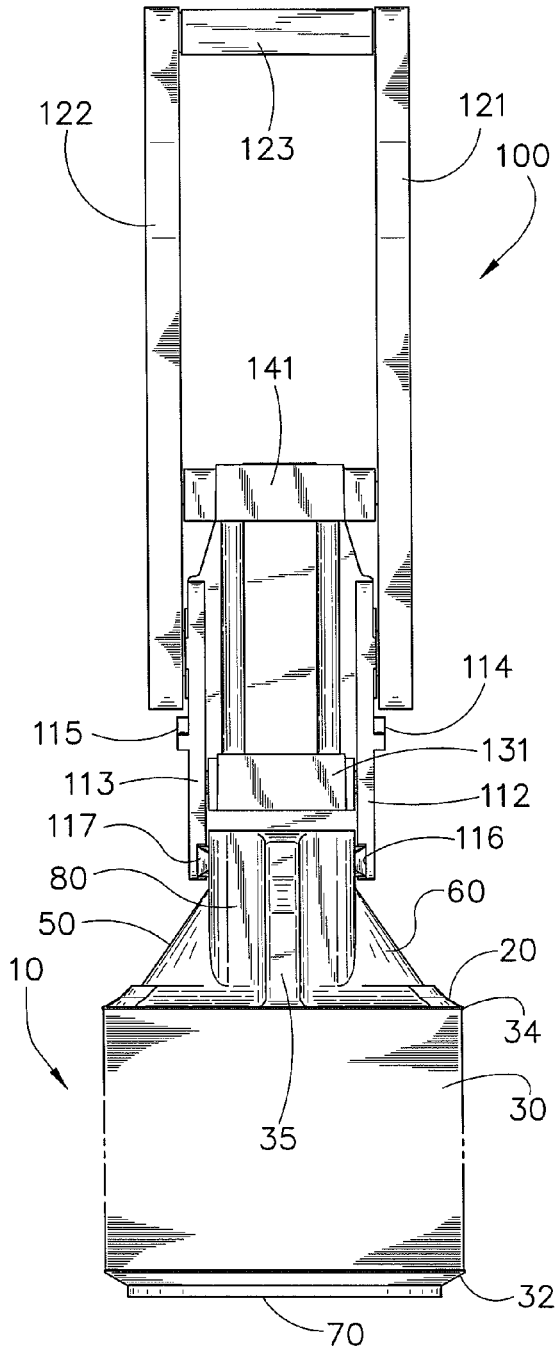
FIG. 3 is a front elevational view of the cylindrically-shaped bin showing the neck and opening of the bin in a can-receiving relation to the compacting mechanism.
Figure 4:
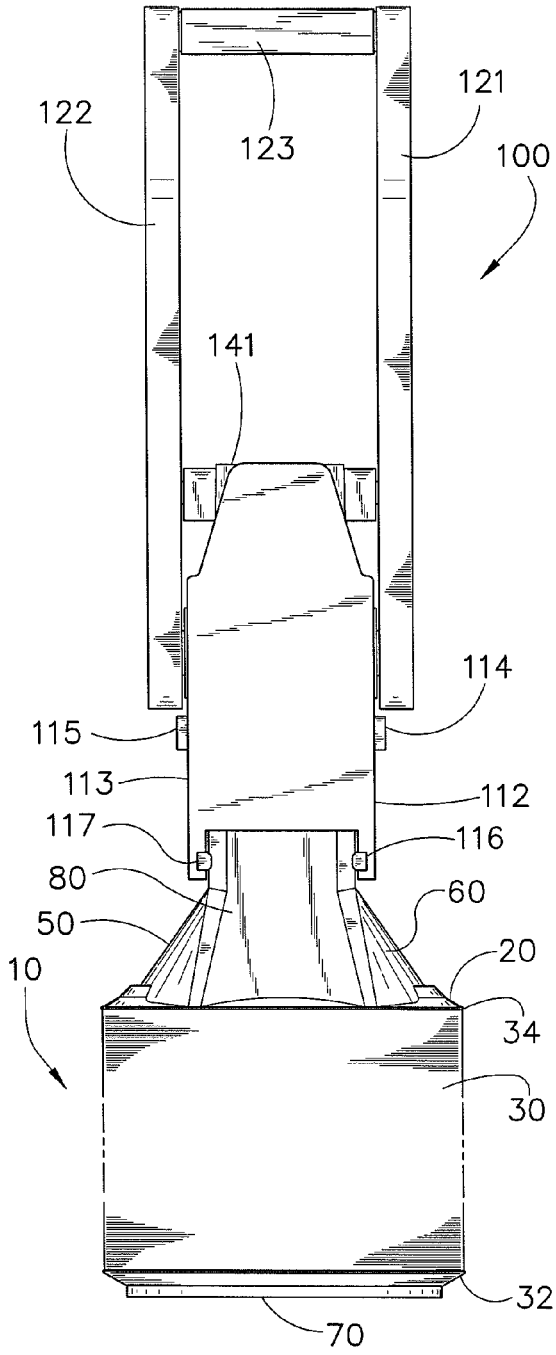
FIG. 4 is a rear elevational view of the cylindrically-shaped bin and the compacting mechanism shown in FIG. 3.
Figure 5:
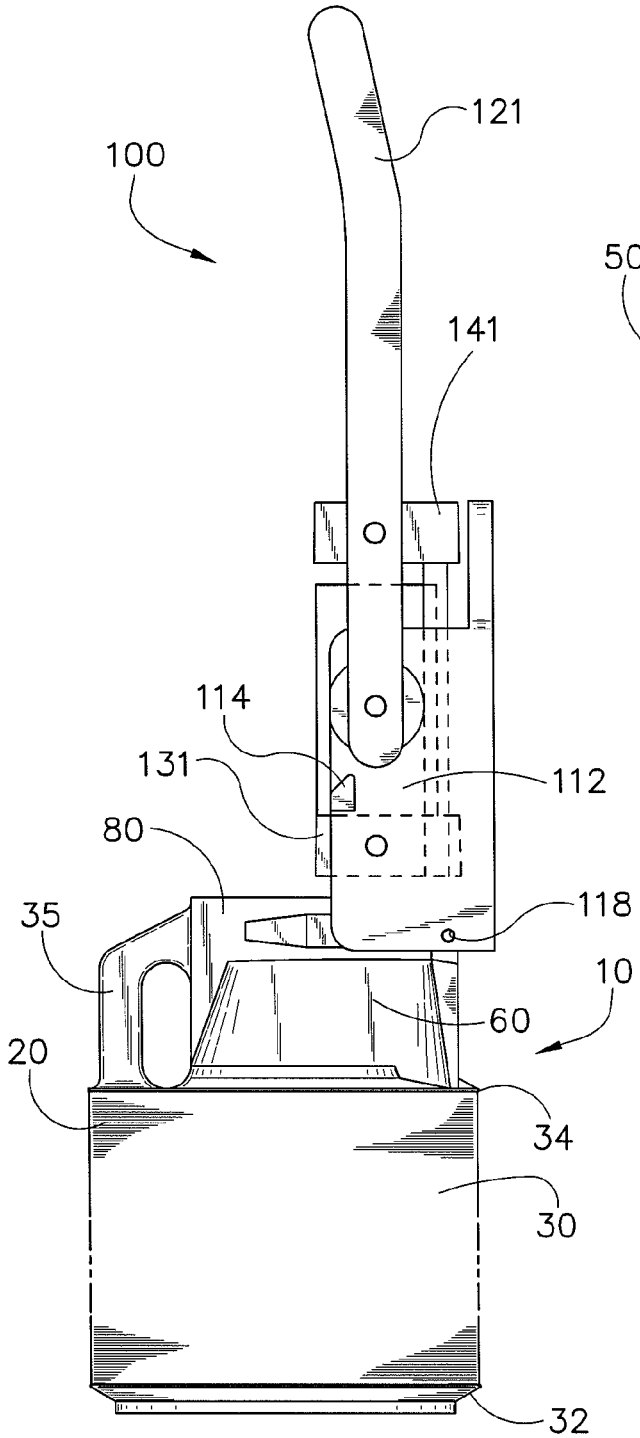
FIG. 5 is a right side elevational view of the cylindrically-shaped bin and the compacting mechanism shown in FIG. 3.
Figure 6:
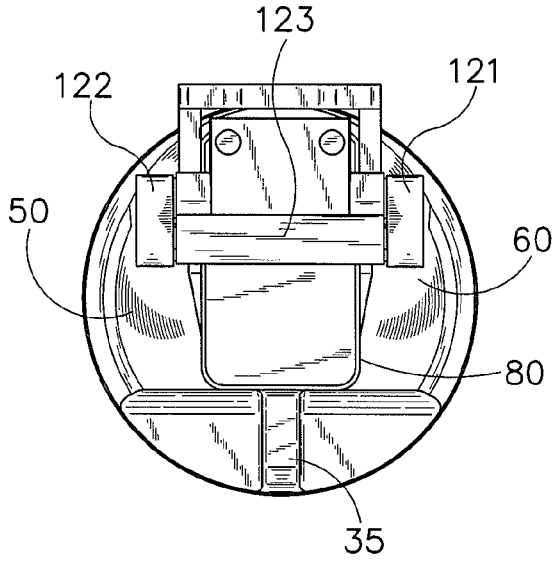
FIG. 6 is a top plan view of the cylindrically-shaped bin illustrated in FIG. 3.

Referring now to the drawings in detail wherein like numbers represent like elements throughout, FIG. 1 illustrates a cylindrically-shaped can collection bin, generally identified 10, constructed in accordance with the present invention. For purposes of illustration, the length of the bin 10 has been shortened and appears to be more stout than in actuality. Note the dashed lines throughout the drawings which illustrate this aspect. In other words, the bin 10 of the preferred embodiment is dimensioned to be more closely proportioned to a 12 ounce aluminum beverage can of current manufacture.

As shown, the can collection bin 10 in the preferred embodiment is a generally hollow structure that is unitary in construction and includes an integrally formed main collection bin body 20 comprised of a cylindrically-shaped and continuous sidewall 30. This contour is intentionally configured to represent an over-sized aluminum beverage can. The sidewall 30 can include indicia that replicates popular beverage can designs or may be overwrapped by a separate media 22 in the form of a paper wrap, vinyl label, plastic sleeve, or the like, for the same purposes. In the preferred embodiment, the main collection bin body 20 is also generally symmetrical. Insofar as the unitary can collection bin 10 can be blow molded of a plastic material, this symmetry is desirable, but not required, although the symmetry of the cylindrically-shaped sidewall 30 is a limitation of the present invention.

Figure 7:
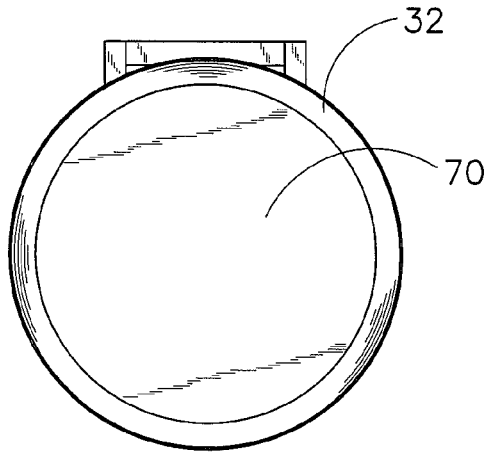
FIG. 7 is a bottom plan view of the cylindrically-shaped bin shown in FIG. 3.

The continuous sidewall 30 of the hollow bin body 20 includes a bottom edge 32, and a top edge 34. The bottom edge 32 also forms the edge of a bin floor 70. See FIG. 7. As alluded to, in the unitary construction of the preferred embodiment, the continuous sidewall 30 and floor 70 are integrally formed into a single structure.

Figure 8:
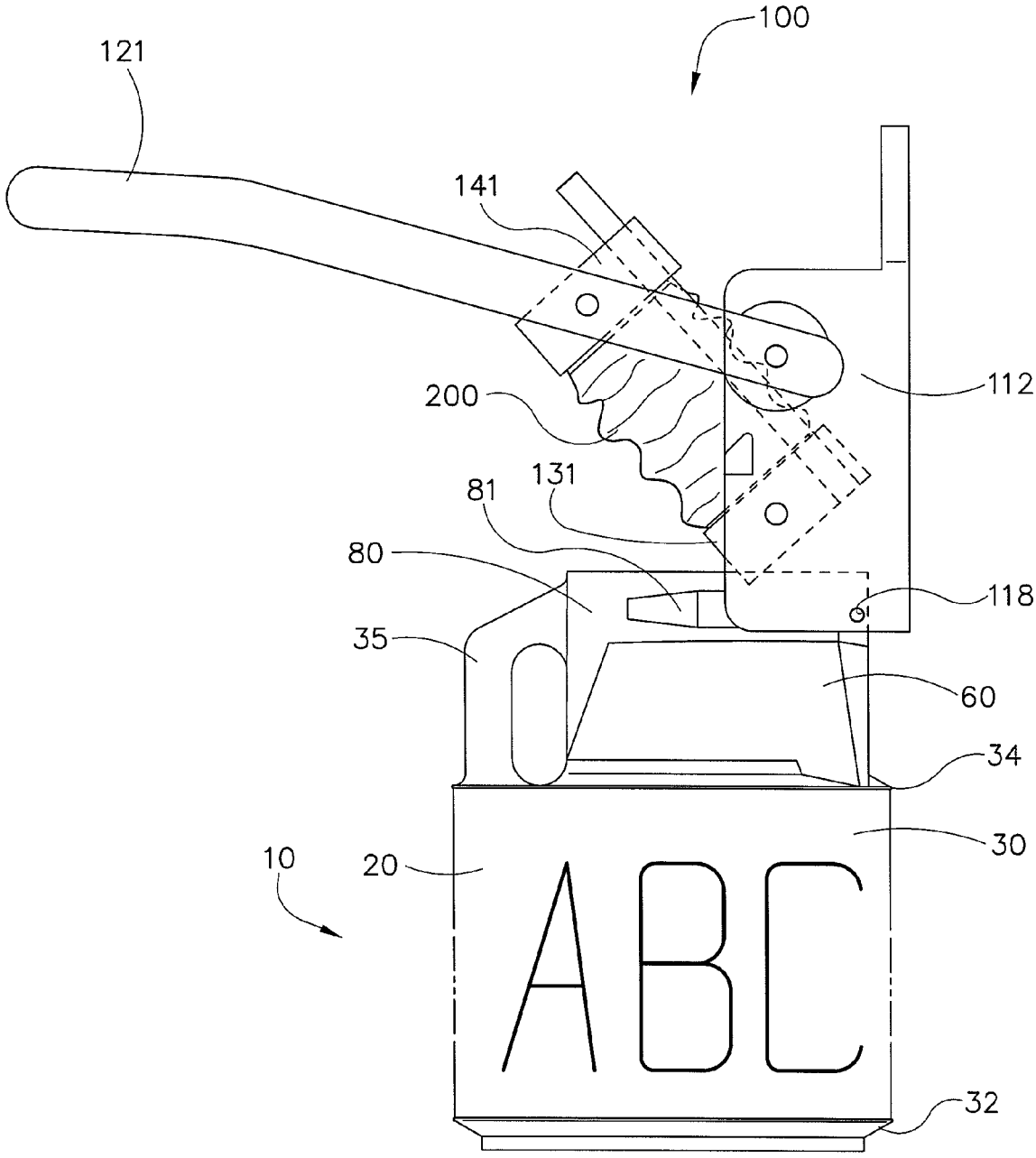
FIG. 8 is a slightly enlarged right side elevational view of the cylindrically-shaped bin and the compacting mechanism shown in FIG. 3 and illustrating the compacting mechanism in a partially-down handle compacting position.

Towards the uppermost portion of the main collection bin body 20 is a bin neck 80. As shown in FIGS. 1 through 4, it will be seen that side walls 50, 60 are tapered inwardly towards the bin neck 80. In this fashion, the hollow can collection bin 10 is functionally adapted to be used with the can compacting mechanism 100 of prior invention. Refer again to FIG. 1. As shown, the bin neck 80 of the can collection bin 10 is functionally adapted to fit between the lowermost portion of the side support members 112, 113. It is to be understood that the inwardly-facing, opposing faces of each of the side support members 112, 113 include a generally horizontal groove or slot , 116, 117 defined within them. Each slot 116, 117 is functionally adapted to receive a flange 81, 82 that is situated to each wall side 50, 60 of the neck 80 of the can collection bin 10. In this fashion, the can collection bin 10 is slidably receivable within the lowermost portion of the can compacting mechanism 100 of prior invention. With this orientation, a can 200 that has been compacted between the compacting plates 131, 141 of the can compacting mechanism 100 of prior invention will, immediately following compaction, drop downwardly and into the can collection bin 10 through the bin neck 80. See FIGS. 8 and 9. A number of such compacted cans can be accumulated before the bin 10 requires emptying.

Significant in the configuration of the bin neck 80 of the cylindrically-shaped can collection bin 10 of the present invention is the fact that the neck 80 is, in cross section, a generally rectangular-shaped structure. Similarly, the body opening 84 situated at the uppermost portion of the neck 80 is a generally rectangular-shaped aperture and through which compacted cans 200 are intended to pass as they drop by gravity from between the compacting plates 131, 141 of the can compacting mechanism 100 of prior invention. The taper of the bin body 20 near the uppermost walls 50, 60 allow the can compacting mechanism 100 of prior invention to operate through its full compression cycle without impediment. In the preferred embodiment, the neck 80 is configured of smooth and tapered lines to avoid any impingement of the compacted cans 200 as they drop into the bin 10. In operation, this allows longitudinally extending, parallel handle members 121, 122 of the can compacting mechanism 100 to move fully downwardly by means of the interposed handle 123 to the point that each handle member 121, 122 contacts a stop member 114, 115, respectively, of the mechanism 100, but not the body 20 of the bin 10. In the preferred embodiment, the bin 20 includes a handle 35 for convenient grasping of the bin 10 by hand for removing it from the compacting mechanism 100 of prior invention and allowing the user to empty its contents without requiring any direct contact with the compacted cans.

In application, and referring again more particularly to FIG. 1, the user mounts the can compacting mechanism 100 in a location that is desired or required by the user. As alluded to earlier, it is intended that, by concealment of unsightly compacted cans within the bin 10, the combined and relatively compact assembly of the compacting mechanism 100 and bin 10 can be mounted in a kitchen, utility room, or other area of the house without the need to conceal the assembly in a basement or garage. This is accomplished by the elimination of an ad hoc container for holding the compacted cans 200 in, such as a bulky and unsightly garbage can-like device of the prior art. Once located and mounted, the user inserts the bin 10 within the lowermost portion of the can compacting mechanism 100. This is accomplished by aligning the flanges 81, 82 of the bin 10 with the slots 116, 117, respectively, of the compacting mechanism 100. It is to be understood that other interlocking means could be used, or the slots 116, 117, could be defined within the bin 10 and the flanges 81, 82, or other securement means, could be defined within the compacting mechanism 100 without deviating from the scope of the present invention. It is also to be understood that the securement means could also include a positive locking mechanism to prevent inadvertent detachment of the bin 10 and provide the user with tactile or visual confirmation that the bin 10 is secure in its proper position. In the embodiment illustrated herein, this is accomplished by use of one or more cooperating bumps and corresponding recesses defined within the securement means. See, for example, FIG. 1 in which the bump 83 is defined within the flange 81. The bump 83 is functionally adopted to be captured by a portion of a hole 118 that is defined within the side support member 112.

Figure 9:
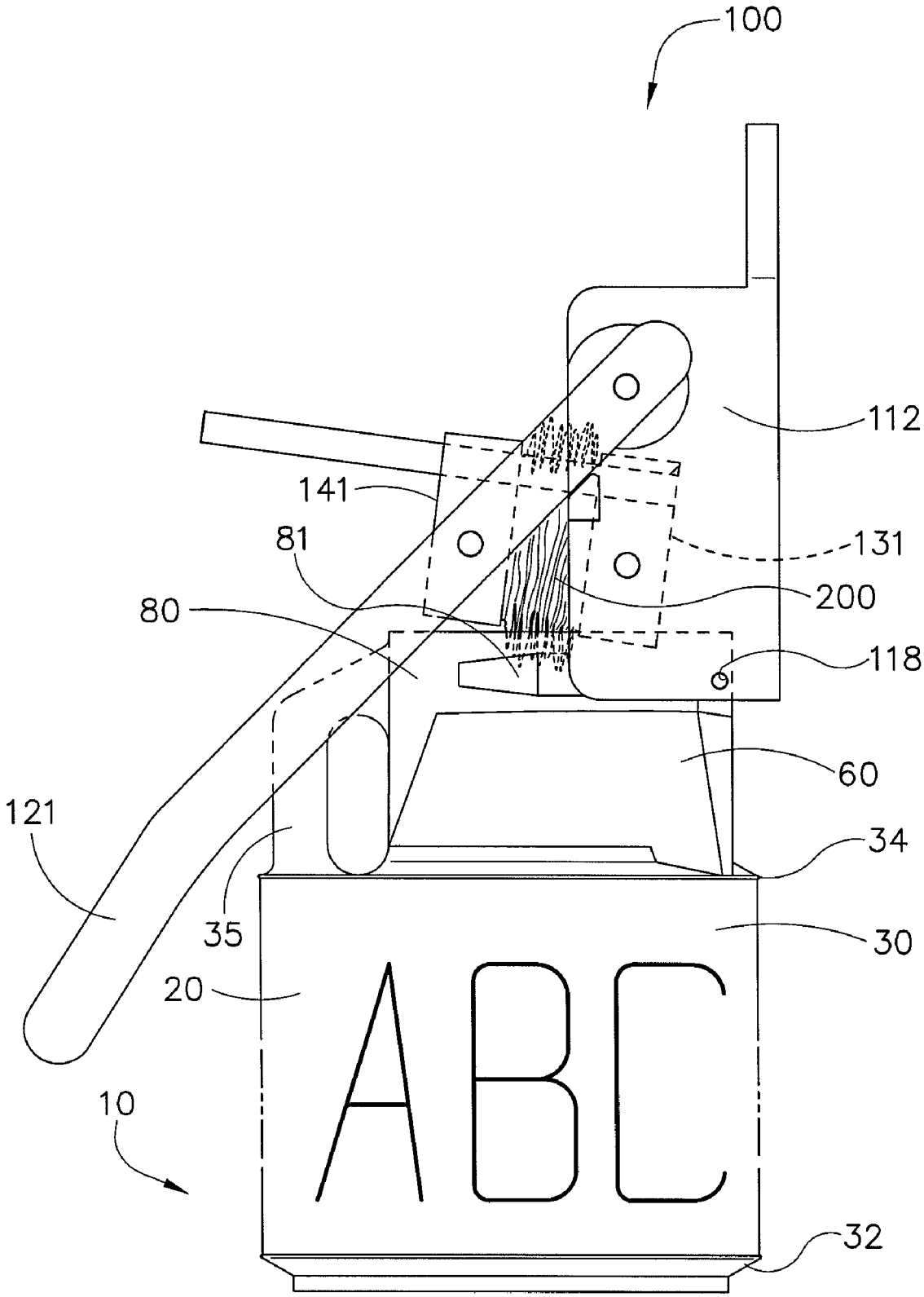
FIG. 9 is a view similar to FIG. 8 but showing the cylindrically-shaped compacting mechanism in its fully-down handle compacting position and just prior to the compacted can falling into the bin.

The bin 10 is filled with compacted cans 200 during repeated use of the mechanism 100. Any residue coming from the cans is contained within and is collected by the bin 10 as well and is unobservable by the user. As shown in FIG. 9, the downward motion of the handle members 121, 122 of the can compacting mechanism 100 is not impeded due to the tapered walls 50, 60 to either side of the neck 80, which neck 80 contains an opening 84 in it for receiving compacted cans therethrough. The handle members 121, 122 are also not impeded by the presence of the bin handle 35, the handle members effectively straddling the handle 35 and the handle 123 extending well beyond it. See FIG. 9. The compacted cans 200 drop, without any encumbrance, into the bin 10 due to the smooth lines of the neck 80.

When the collection bin 10 becomes filled to the point that the user wishes to dispose of its contents, the user grasps the handle 35 and pulls the bin 10 out and away from the compacting mechanism 100 thereby releasing the flanges 81, 82 of the bin 10 from the slots 132, 133 of the compacting mechanism 100. The amount of force to be exerted by the user would also be sufficient to overcome the securement means or positive locking mechanism used in the device 100. The bin 10 is emptied and reinstalled as stated above. Occasionally, the bin 10 may be rinsed and cleaned, and may even be safely placed within a dishwasher for thorough cleaning, the bin 10 being constructed of dishwasher safe material in the preferred embodiment.

As previously alluded to, an essential feature of the bin 10 of the present invention is the cylindrically-shaped bin body 20. The sidewall 30 of the bin body 20 can be used as a media for printing indicia on the outer surface of the bin 10. Alternatively, the sidewall 30 of the bin body 20 can be used as a carrier for the paper, vinyl or plastic printed label or wrap 22 that encircles the body 20, the wrap 22 covering the circumference of the sidewall 30 and extending between the upper edge 34 and lower edge 32 of the sidewall 30. In the preferred embodiment, the wrap 22 can also be in the form of a plastic, sleeve-like member that is applied to the body 20. Also in the preferred embodiment, the lower edge 32 of the sidewall 30 is shaped in the profile of an aluminum can base of current manufacture. This enhances the appearance of the bin 10 as a larger version of a can 200 of the type that can be collected within the bin body 20. The wrap 22 can be printed to appear like almost any can label for every beverage sold today in an aluminum can. In this fashion, the bin 10 and wrap 22 can also serve as a marketing tool for bottlers. It is to be understood, however, that the wrap 22 can also be used as a carrier for other suitable images, including images for private branding applications.

Based upon the foregoing, it will be seen that there has been provided a new and useful cylindrically-shaped novelty bin of unitary construction that can be easily used by a consumer with an aluminum can compacting mechanism of prior invention, which bin has a minimal number of integrally formed parts and requires only a minimal number of steps to use; that is conveniently locatable immediately beneath the aluminum can compacting mechanism of prior invention; that is functionally adapted to be removably attachable to the can compacting device of prior invention; that includes means for preventing the inadvertent detachment of the bin from the can compacting mechanism except where detachment was desired or required by the user; that does not interfere with the operation of the prior can compacting mechanism, and particularly with regard to the full motion of the handle through its compression cycle; that is attractive in the accumulation, but not display, of unsightly compacted cans as they are collected; that is self-contained and cleanable to collect and allow the removal of any residue that may escape from the compacted cans; that simulates the appearance of a larger aluminum can of the type that is collected by the bin; and that includes indicia or printed matter applied directly to the bin or applied to a label or wrap that encircles the bin to serve as an advertising media for bottlers who sell and promote the sale of beverages in aluminum cans as well as other suitable images, including images for private branding applications.

The invention claimed is:

1. For use with a can compacting mechanism, the mechanism comprising a pair of side support members and a pair of cooperating compaction plates, said plates being movable towards one another to compact an upright can situated therebetween when a handle is rotated downwardly, a can collection bin which comprises:

a unitary bin body, said bin body comprising a continuous and cylindrically-shaped sidewall having a top edge and a bottom edge, a floor wherein the bottom edge of the sidewall forms the edge of the floor, and a top surface, a pair of sidewalls rising upwardly and inwardly from the top surface, a neck rising upwardly from a top portion of the pair of sidewalls and being configured in a generally rectangular-shaped structure, the neck further comprising a pair of flanges extending outwardly therefrom, and a bin handle having one end connected to the neck and the other end of the bin handle is connected to a substantially flat portion of the top surface of the bin body;

indicia from a group consisting of indicia applied directly to the sidewall, indicia applied to a paper or vinyl wrap that is attached to the sidewall, indicia applied to a paper or vinyl label that is attached to the sidewall, or indicia applied to a plastic sleeve that surrounds the sidewall;

a pair of slots defined within the side support members of the compacting mechanism for accommodating the flanges extending outwardly from the bin neck; and a positively locking mechanism for preventing inadvertent detachment of the bin from the can compacting mechanism, the positively locking mechanism comprises a bump positioned on the flange and a hole formed within the side support member for capturing the bump;

whereby compacted cans that drop from the mechanism are collected within the bin.

2. The cylindrically-shaped bin of claim 1 wherein the bin is a generally hollow structure.

3. The cylindrically-shaped bin of claim 1 wherein the cylindrically-shaped sidewall and the floor of the bin body are integrally formed of a plastic material.

4. An improved can compacting mechanism, the mechanism comprising a pair of side support members and a pair of cooperating compaction plates, said plates being movable towards one another to compact an upright can situated therebetween when a handle is rotated downwardly, the improvement comprising:

a can collection bin comprising a bin body having a continuous and cylindrically-shaped sidewall and a top surface, a pair of sidewalls rising upwardly and inwardly from the top surface, a generally upwardly opening rectangularly shaped neck rising upwardly from a top portion of the pair of sidewalls, and a bin handle having one end connected to the neck and the other end of the bin handle is connected to a substantially flat portion of the top surface of the bin body, the generally upwardly opening rectangularly shaped neck comprising a pair of flanges extending outwardly therefrom, the flanges being accommodated by a corresponding pair of slots defined within the side support members of the compacting mechanism for accommodating the flanges extending outwardly from the bin neck, at least one of the flanges comprises a bump for releasably retaining the flanges within the cooperating slots of the compacting mechanism such that the can collection bin is removably attachable to the can compacting mechanism, at least one of the side support members having a hole for capturing the bump; and indicia from a group consisting of indicia applied directly to the sidewall, indicia applied to a paper or vinyl wrap that is attached to the sidewall, indicia applied to a paper or vinyl label that is attached to the sidewall, or indicia applied to a plastic sleeve that surrounds the sidewall.

5. The improved can compacting mechanism of claim 4 wherein the bin is a generally hollow structure that is integrally formed of a unitary plastic material.

* * * * *